US006550938B2

(12) United States Patent
Barnes, II et al.

(10) Patent No.: US 6,550,938 B2
(45) Date of Patent: Apr. 22, 2003

(54) LIGHTING FIXTURE EMPLOYING A PARTIALLY REFLECTIVE PARTIALLY TRANSMITTIVE POLYMERIC REFLECTOR

(75) Inventors: Thomas F. Barnes, II, Charlevoix, MI (US); James T. Hamilton, Charlevoix, MI (US)

(73) Assignee: Lexalite International Corporation, Charlevoix, MI (US)

( * ) Notice: Subject to any disclaimer, the term of this patent is extended or adjusted under 35 U.S.C. 154(b) by 15 days.

(21) Appl. No.: 09/500,620

(22) Filed: Feb. 9, 2000

(65) Prior Publication Data

US 2002/0082310 A1 Jun. 27, 2002

(51) Int. Cl.[7] ..... F21V 3/02; F21V 3/04

(52) U.S. Cl. ..... 362/311; 362/350; 362/362; 521/95; 521/96; 521/97

(58) Field of Search ..... 521/97, 95, 56; 362/311, 350, 362

(56) References Cited

U.S. PATENT DOCUMENTS 3,607,273 A * 9/1971 Kinney ..... 96/35
3,772,128 A 11/1973 Kahn et al.
3,926,708 A * 12/1975 Long ..... 156/242
4,796,160 A 1/1989 Kahn
5,143,446 A 9/1992 Barnes et al.
5,158,986 A 10/1992 Cha et al.
5,334,356 A 8/1994 Baldwin et al.
5,348,458 A * 9/1994 Pontiff ..... 425/4 R
5,596,450 A 1/1997 Hannon et al.
5,844,731 A * 12/1998 Kabumoto et al. ..... 359/869
5,925,450 A * 7/1999 Karabedian et al. ..... 428/304.4
5,945,461 A * 8/1999 Gosiewski et al. ..... 521/123

* cited by examiner

*Primary Examiner*—James J. Seidleck
*Assistant Examiner*—Melanie Bissett
(74) *Attorney, Agent, or Firm*—Joan Pennington

(57) ABSTRACT

In brief, a lighting fixture is provided. The lighting fixture has both a transmitted and reflected light component employing a polymeric material which has an appearance, in varying degrees, of white. The material has internal elements which can be varied to be either highly reflective or permit efficient diffuse transmission of incident light rays. The ratio of reflected to transmitted light and the degree of diffusion are tailored to the application, light source and desired appearance. The material is adapted for providing a selected diffuse transmission component of a total fixture output. The material provides a set diffuse transmission component of greater than 1% and less than 25% where the material is formed by pigmenting a transparent material with a white pigment. The material provides a set diffuse transmission component of greater than 1% and less than 99% where the material is formed by a foamed polymeric material, by an expanded bead material, by blending transparent materials having different refractive indices, or by adding a filler to a polymeric material.

7 Claims, 3 Drawing Sheets

LIGHTING FIXTURE EMPLOYING A PARTIALLY REFLECTIVE PARTIALLY TRANSMITTIVE POLYMERIC REFLECTOR

FIELD OF THE INVENTION

The present invention relates generally to improved lighting fixtures having both a transmitted and reflected light component employing a material, such as, a polymeric material which has an appearance, in varying degrees, of white.

DESCRIPTION OF THE RELATED ART

As used in the present description and claims, the term lighting fixture includes luminaries and indoor and outdoor lighting fixtures. Typically a lighting fixture includes a light source, a light reflecting member, such as, a reflector, and/or a light transmitting member, such as, a refractor, a lens, or an enclosure and/or a partially reflective partially transmittive optical component.

At present there are few choices in creating efficient lighting fixtures which have a partially reflective partially transmittive optical component.

At present, many fixtures utilize acrylic, polycarbonate or glass prismatic reflectors which provide the benefits of uniform distribution, vertical illumination, glare control and a diffuse transmission component which serves to reduce apparent brightness of the fixture, by lighting the ceiling above the fixture. In comparison, aluminum or painted steel reflectors are opaque and thus cannot provide a uniform diffuse transmission or vertical illumination component, and apparent brightness is much higher, causing discomfort glare. Perforated aluminum or steel reflectors have not enjoyed success as an alternative as the holes collect excessive dirt and the optical system cannot be readily enclosed. A limitation of the prismatic reflectors mentioned above is the relatively high percentage of diffuse transmission. Even the best acrylic prismatic reflectors generally exhibit diffuse transmission of 20% of total fixture output. When used with larger sources, such as multiple compact fluorescent lamps, the percentage is closer to 30%. Translucent pigmented white reflectors have been produced, but they too have had diffuse transmission components of approximately 25–30%.

U.S. Pat. No. 5,596,450 issued Jan. 21, 1997 to Hannon et al. and assigned to W. L. Gore and Associates, Inc. discloses an expanded polytetrafluoroethylene (PTFE) material. The expanded PTFE in a film can be highly reflective, in the range of 98.5%, and still have a small amount of transmission, about 1.5%. However, this material and process are expensive and primarily suited to two-dimensional applications.

A need exists for an improved lighting fixture having both a transmitted and reflected light component. It is desirable to provide a lighting fixture component with reduced diffuse transmission, while not completely eliminating it. The benefits of such a product include better coefficients of utilization, improved horizontal footcandles, and reduced glare. In outdoor applications it also provides improved shielding angles and reduced contribution to sky-glow versus typical vertical refractors.

SUMMARY OF THE INVENTION

A principal object of the present invention is to provide an improved lighting fixture having both a transmitted and reflected light component employing a polymeric material which has an appearance, in varying degrees, of white. Other important objects of the present invention are to provide such improved lighting fixture having both a transmitted and reflected component employing a polymeric material which has an appearance, in varying degrees, of white substantially without negative effect and that overcome many of the disadvantages of prior art arrangements.

In brief, a lighting fixture is provided. The lighting fixture has both a transmitted and reflected light component employing a polymeric material which has an appearance, in varying degrees, of white. The material has internal elements which can be varied to be either highly reflective or permit efficient diffuse transmission of incident light rays. The ratio of reflected to transmitted light and the degree of diffusion are tailored to the application, light source and desired appearance. The material is adapted for providing a selected diffuse transmission component of total fixture output.

In accordance with features of the invention, the material provides a set diffuse transmission component of greater than 1% and less than 25% where the material is formed by pigmenting a transparent material with a white pigment. The material provides a set diffuse transmission component of greater than 1% and less than 99% where the material is formed by a foamed polymeric material, by an expanded bead material, by blending transparent materials having different refractive indices, or by adding a filler to a polymeric material.

BRIEF DESCRIPTION OF DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
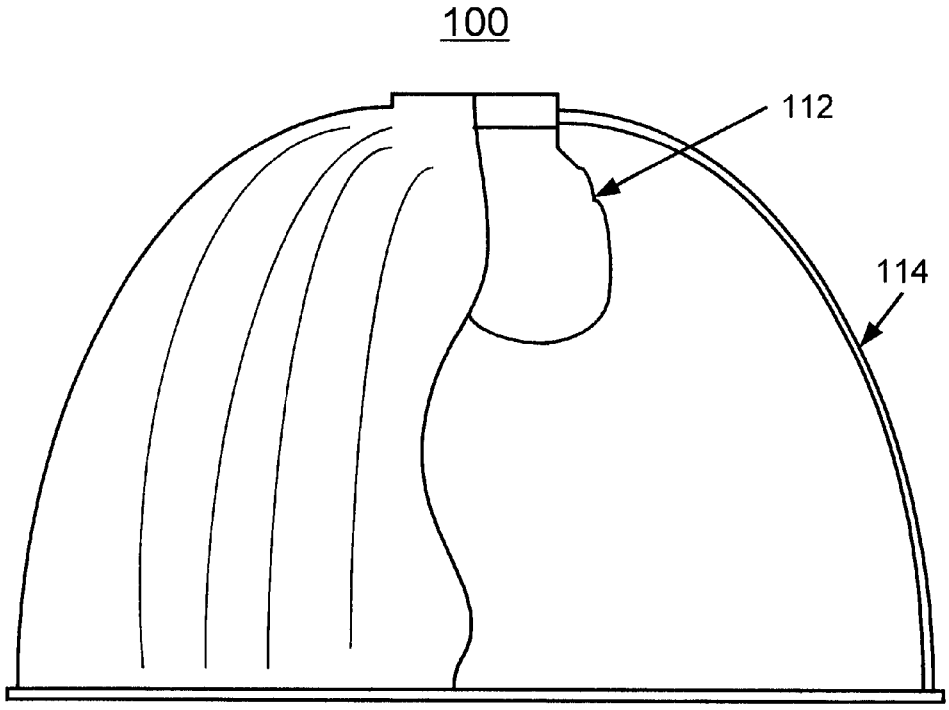
FIG. 1 is a diagram illustrating a lighting fixture having both a transmitted and reflected component employing a polymeric material which has an appearance, in varying degrees, of white in accordance with the preferred embodiment.

Having reference now to the drawings, in FIG. 1, there is shown a lighting fixture having both a transmitted and reflected component employing a polymeric material which has an appearance, in varying degrees, of white of the preferred embodiment generally designated by the reference character 100. As shown in FIG. 1, lighting fixture 100 includes a light source 112 and a light transmitting and reflecting member 114 for reflecting and transmitting light. While lighting fixture 100 is illustrated with the bowl shaped reflector member 114, it should be understood that principles of the present invention can be used with various optical components of lighting fixtures. In general, a partial list of the applications includes bowl shaped reflectors, extruded profiles for direct/indirect, extruded sheet and film, recessed ceiling reflectors, diffusers of all shapes and forming techniques.

In accordance with features of the invention, lighting fixture 100 yields a desired diffuse transmission component of a total fixture output. For example, the material of the preferred embodiment has a set diffuse transmission component of greater than 1% and less than 25% where the material is formed by pigmenting a transparent material with a white pigment. The material of the preferred embodiment has a set diffuse transmission component of greater than 1% and less than 99% where the material is formed by a foamed polymeric material, by an expanded bead material, by blending transparent materials having different refractive indices, or by adding a filler to a polymeric material.

The present invention teaches new techniques for producing an efficient reflector system with limited diffuse transmission. An improved lighting fixture is provided having both a transmitted and reflected light component employing a polymeric material which has an appearance, in varying degrees, of white. The material has internal elements which can be varied to be either highly reflective or permit efficient diffuse transmission of incident light rays. The ratio of reflected to transmitted light and the degree of diffusion are tailored to the application, light source and desired appearance. Also, there are taught a variety of methods of achieving highly efficient reflection and transmission by creating optical systems which employ white appearing materials in accordance with the preferred embodiment.

Figure 2:
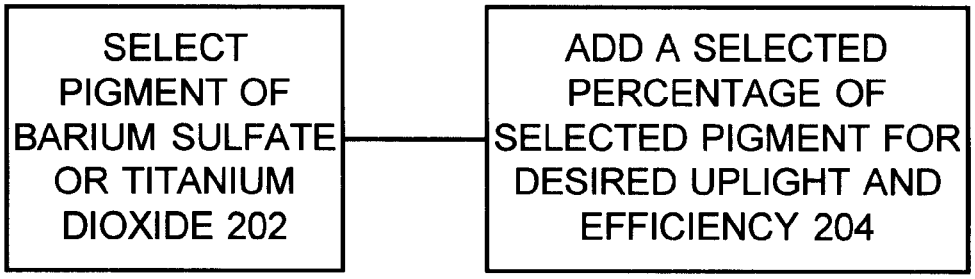
FIGS. 2, 3, 4, 5, 6, and 7 are charts illustrating exemplary sequential steps for creating a lighting fixture having both a transmitted and reflected component employing a polymeric material which has an appearance, in varying degrees, of white in accordance with the preferred embodiment.

Referring to FIG. 2, there are shown exemplary steps for producing a lighting fixture having both a transmitted and reflected component employing a polymeric material which has an appearance, in varying degrees, of white in accordance with the preferred embodiment. In a first development, we discovered that with an acrylic pigmented with BaSO4 (barium sulfate) or TiO2 (titanium dioxide) at loadings substantially higher than previously developed conventional materials, diffuse transmission can be reduced to 3% through less than 25% of fixture output, while maintaining good overall efficiency. As an example, in injection molding a bowl shaped reflector, the percentage of CYRO H-15-003-88159 white concentrate to HID grade acrylic was varied from 5% or 1% TiO2, which resulted in diffuse transmission of 24.4% with efficiency of 90.6%, to 100.0% concentrate or 20% TiO2, which resulted in diffuse transmission of 3.7% with efficiency of 85.5%. At a 7.5% concentrate or 1.5% TiO2, a diffuse transmission of 18.3% with an efficiency of 86.7% is provided. As indicated in a block 202, a pigment of barium sulfate BaSO4 or titanium dioxide TiO2 is selected. A selected percentage of the selected white pigment, barium sulfate BaSO4 or titanium dioxide TiO2 is added to an acrylic to achieve a desired diffuse transmission and efficiency as indicated in a block 204.

Figure 3:
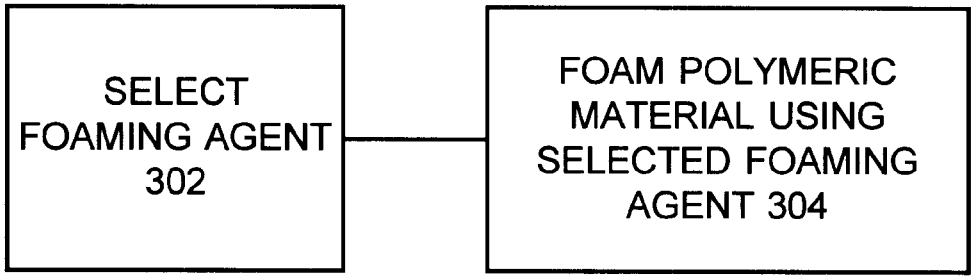

Referring to FIG. 3, there are shown exemplary steps for producing a lighting fixture having both a transmitted and reflected component employing a polymeric material which has an appearance, in varying degrees, of white in accordance with the preferred embodiment. A second development for similar applications achieves a more surprising result. We now teach that by foaming transparent thermoplastics such as acrylic, we can achieve high reflectivity and high transmission at lower cost and in methods suitable for two dimensional, extruded products as well as three dimensional products, such as bowl shaped reflectors. The desired foaming may be accomplished by the use of any of several methods including, but not limited to, chemical foaming/blowing agents, calcium carbonate, water, or gases being added to the polymer prior to or during molding or extruding, forming, calendering, and the like. For example, when molded in a bowl shaped reflector, diffuse transmission was varied from 2% to 20% with efficiency of greater than 90%. Other benefits of this technology include weight savings, reduced molding cycle time, reduced press tonnage, and lower tooling costs. A foaming agent is selected as indicated in a block 302. The foaming agent can be a gas, such as nitrogen and carbon dioxide, a chemical blowing agent, such as sodium bicarbonate and citric acid or simply sodium bicarbonate. Also, with controlled environment and appropriate equipment, water can be an effective foaming agent. The polymeric material, such as an acrylic or polycarbonate, is foamed using the selected foaming agent as indicated in a block 304.

Figure 4:
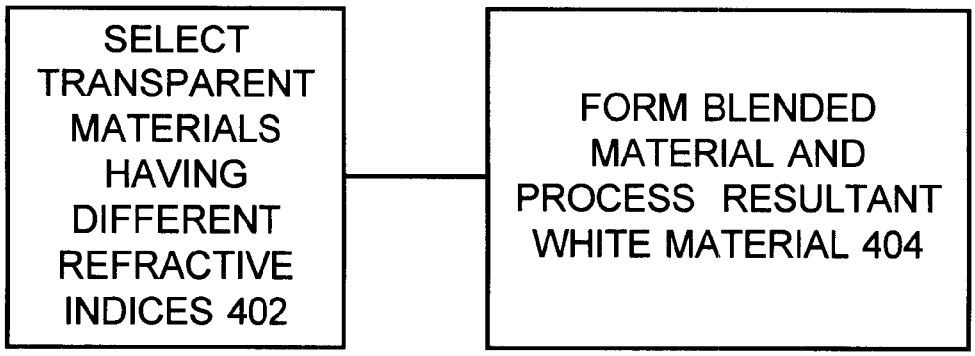

Referring to FIG. 4, there are shown exemplary steps for producing a lighting fixture having both a transmitted and reflected component employing a polymeric material which has an appearance, in varying degrees, of white in accordance with the preferred embodiment. A third development achieves the desired reflectivity/transmission ratios by a blending of two or more transparent materials, such as acrylic and polycarbonate, having different refractive indices. The result is a white appearing polymeric product with variable transmission/reflection properties. For example, when a blend of acrylic and polycarbonate is molded into a bowl shaped reflector, diffuse transmission of 16.2% was provided, while efficiency was 86.1%. As indicated in a block 402, transparent materials having different refractive indices are selected. Then a blended material is formed and the resultant blended white appearing material is processed to provide the lighting fixture component as indicated in a block 404.

Figure 5:
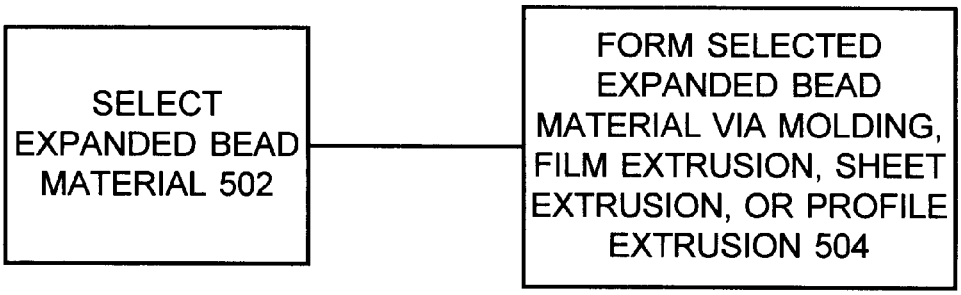

Referring to FIG. 5, there are shown exemplary steps for producing a lighting fixture having both a transmitted and reflected component employing a polymeric material which has an appearance, in varying degrees, of white in accordance with the preferred embodiment. A fourth development for similar applications also has surprising results. For years expanded polystyrene (EPS) has been available in film, sheet and molded products, such as cups, coolers and insulation. However, we now learn that the bead structure and white appearance provide a highly reflective and efficient lighting component. Tests of a prototype bowl shaped reflector have yielded diffuse transmission of only 5.8% and efficiency of 95%. Expanded polystyrene is not an ideal long term material due to its high smoke generation and tendency to yellow under ultra-violet (UV) radiation. An expanded bead acrylic or expanded polymethyl methacrylate (ePMMA) are better suited materials for lighting applications. Expanded bead acrylic, which has yet to be commercially developed, is an ideal alternative to styrene for its enhanced ultraviolet stability. An expanded bead material is selected as indicated in a block 502. The selected expanded bead material is formed, via molding, film extrusion, sheet extrusion, or profile extrusion as indicated in a block 504.

Figure 6:
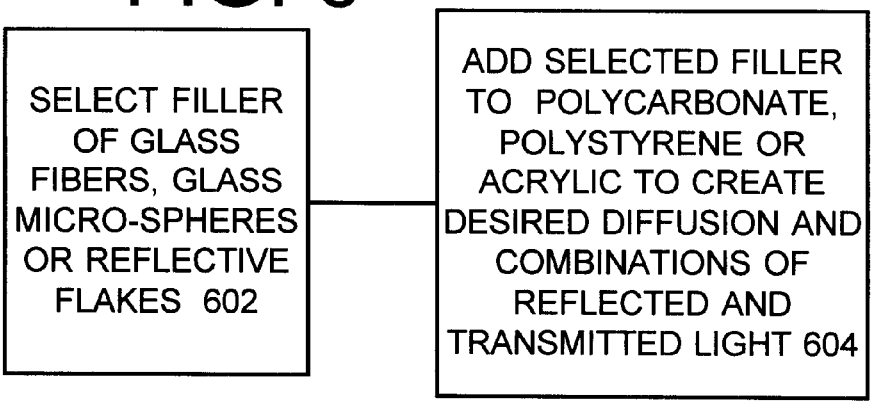

Referring to FIG. 6, there are shown exemplary steps for producing a lighting fixture having both a transmitted and reflected component employing a polymeric material which has an appearance, in varying degrees, of white in accordance with the preferred embodiment. A fifth development is the discovery that glass fibers and glass micro-spheres as fillers in an acrylic, polystyrene or polycarbonate material also create desirable diffusion and combinations of reflected/transmitted light. Glass micro-spheres from 0 to 150 microns in diameter are added as fillers to acrylic at various ratios prior to injection molding. The micro-spheres have a density of 0.17 g/cm3 and are approximately ⅕ of the density of acrylic. A combination of the air gaps and refractive differences between acrylic and glass results in diffusion and varying ratios of reflection and transmission depending on the loading of spheres to raw material. Glass fibers achieve a like result where the refractive index alone accounts for the diffusion and reflection and transmission rations achieved. A filler of glass fibers, glass micro-spheres or reflective flakes is selected as indicated in a block 602. The selected filler is added to polycarbonate, polystyrene or acrylic to create desired diffusion and combinations of reflected and transmitted light as indicated in a block 604. The optical component is formed, via molding, film extrusion, sheet extrusion, or profile extrusion, injection, blow and rotational molding and thermoforming.

It should be understood that various combinations of the above processes can be used to allow the tailoring of desired properties and aesthetics.

Figure 7:
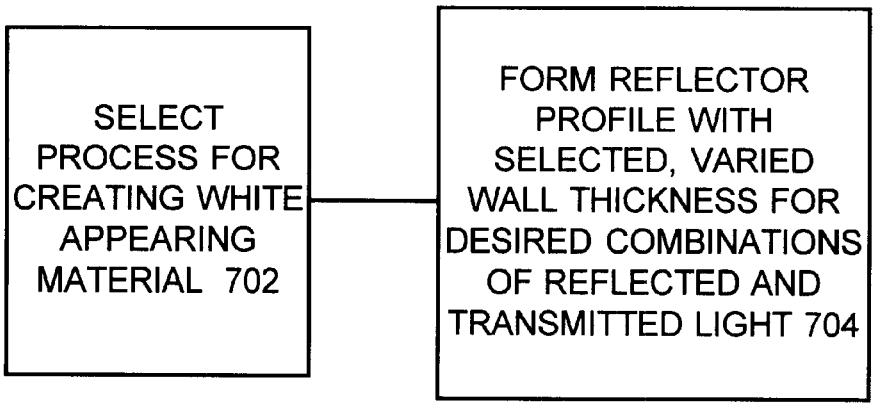

Referring to FIG. 7, there are shown exemplary steps for producing a lighting fixture having both a transmitted and reflected component employing a polymeric material which has an appearance, in varying degrees, of white in accordance with the preferred embodiment. Another development is the discovery that by varying the wall section of the bowl shaped reflector, the relative reflection/transmission ratio is varied due to a change in the volume of diffusing material present. For example, a thinner wall section at the lower ⅓ of the bowl shaped reflector increases the transmission in that zone, thus providing more light at the transition point where the viewer moves from the shielded lamp to the unshielded lamp. As indicated in a block 702, a process is selected for creating white appearing material. Then a reflector profile is formed with selected, varied wall thickness by wall sections for desired combinations of reflected and transmitted light as indicated in a block 702.

While the present invention has been described with reference to the details of the embodiments of the invention shown in the drawing, these details are not intended to limit the scope of the invention as claimed in the appended claims.

What is claimed is:

1. A lighting fixture having both a transmitted and reflected component comprising:

a light transmitting and reflecting bowl shaped injection molded member for reflecting and transmitting light;

said light transmitting and reflecting bowl shaped injection molded member produced from a foamed polymeric material; said foamed polymeric material being an ultraviolet stable material;

said foamed polymeric material having a white characteristic; and said foamed polymeric material having a set density and said light transmitting and reflecting bowl shaped injection molded member having at least one set wall thickness for selectively providing variable transmission and reflection properties and for providing a selected diffuse transmission component of a total fixture output.

2. A lighting fixture as recited in claim 1 wherein said white characteristic is created by said foamed polymeric material and said foamed polymeric material produces said light transmitting and reflecting bowl shaped injection molded member for reflecting and transmitting light wherein said light transmitting and reflecting bowl shaped injection molded member provides a set diffuse transmission component of greater than 1% and less than 99%.

3. A lighting fixture as recited in claim 2 wherein said foamed polymeric material is produced from a transparent polymeric material; said transparent polymeric material is foamed using a gas for creating said white characteristic.

4. A lighting fixture as recited in claim 3 wherein said gas is a selected one of nitrogen and carbon dioxide and wherein said foamed polymeric material is foamed using said selected gas for producing said light transmitting and reflecting member.

5. A lighting fixture having both a transmitted and reflected component comprising:

a light source and a light transmitting and reflecting bowl shaped injection molded member for reflecting and transmitting light;

said light transmitting and reflecting bowl shaped injection molded member produced from a foamed polymeric material; said foamed polymeric material being an ultraviolet stable material; said foamed polymeric material being produced from a transparent polymeric material;

said foamed polymeric material having a white characteristic; said transparent polymeric material being foamed using a chemical blowing/foaming agent for creating said white characteristic; and said foamed polymeric material having a set density and said light transmitting and reflecting bowl shaped injection molded member having at least one set wall thickness for selectively providing variable transmission and reflection properties and for providing a selected diffuse transmission component of a total fixture output.

6. A lighting fixture as recited in claim 5 wherein said chemical blowing/foaming agent comprises a selected one of sodium bicarbonate or a combination of sodium bicarbonate and citric acid.

7. A lighting fixture having both a transmitted and reflected light component comprising:

a light source and an optical bowl shaped injection molded member formed by foaming a transparent polymeric material with a selected foaming agent; said foamed polymeric material being an ultraviolet stable material;

said foamed polymeric material having a white characteristic; and said foamed polymeric material having a set density and said optical bowl shaped injection molded member having at least one wall thickness for selectively providing variable transmission and reflection properties and for providing a selected diffuse transmission component of a total fixture output.

* * * * *